United States Patent [19]

Wiesenberger et al.

[11] 4,280,634

[45] Jul. 28, 1981

[54] DEVICE FOR THE REPEATED OPENING AND CLOSING OF AN APERTURE IN A COVER OF A CONTAINER

[75] Inventors: Alfred Wiesenberger, Wiesbaden-Sonnenberg; Lutz Mager; Erich Kolb, both of Nieder-Olm; Karl Kreim, Fränkisch-Crumbach, all of Fed. Rep. of Germany

[73] Assignees: Firma Peter Eckes; Adam Heldmann Kunststoffverarbeitung, both of Fränkisch-Crumbach, Fed. Rep. of Germany

[21] Appl. No.: 92,540

[22] Filed: Nov. 8, 1979

[30] Foreign Application Priority Data

Nov. 16, 1978 [DE] Fed. Rep. of Germany ..... 2849755

[51] Int. Cl.[3] ..... B65D 53/00

[52] U.S. Cl. ..... 220/270; 220/306; 220/307; 220/403; 220/454; 220/461; 222/541; 222/569

[58] Field of Search ..... 220/402, 454, 403, 461, 220/306, 307, 270; 222/569, 570, 541, 563; 215/256

[56] References Cited

U.S. PATENT DOCUMENTS

| | | | |
|---|---|---|---|
| 3,169,690 | 2/1965 | Scholle | 220/403 |
| 4,076,151 | 2/1978 | Littlefield | 222/541 X |

*Primary Examiner*—George T. Hall

*Attorney, Agent, or Firm*—Toren, McGeady and Stanger

[57] ABSTRACT

Device for the repeated opening and closing of an aperture in a cover of a container which cover is provided at its bottom side with a layer of plastics material, wherein a pouring member 20 of plastics material is provided with a flange 22 which is tightly connected to the plastics material layer 12 on the bottom side of the cover 10 and, at a distance from the upper side of the cover 10, with a bulge 30 which is surrounded by a tightly mounted closing member 28,60.

9 Claims, 3 Drawing Figures

DEVICE FOR THE REPEATED OPENING AND CLOSING OF AN APERTURE IN A COVER OF A CONTAINER

The invention relates to a device for the repeated opening and closing of an aperture in a cover of a container which cover is provided with a layer of plastics material on its bottom side. These are particularly containers which are constructed as disposable packages which are filled with liquid and consist entirely or partially of a flexible material. Containers of this type frequently have the shape of a slender box with a square cross-section and rounded corners. The body of these containers usually consists of a composite of plastics material or cardboard, aluminum and plastics material (from the outside to the inside), and the cover and bottom consists of a composite of aluminum and plastics material (from the outside to the inside). At the joint areas of cover, bottom and body, the plastics material is connected by means of heat-sealing, so that the container becomes tight.

The known containers have the disadvantage that their covers can only be opened with the aid of a tool and cannot be closed tightly again.

Therefore, it is the object of the invention to provide a closure which makes it possible to easily open and again close the container.

For solving this task, the device of the above-mentioned type is characterized by a pouring member of plastics material which is provided with a flange which is tightly connected to the plastics material layer on the bottom side of the cover and, at a distance from the upper side of the cover, with a bulge which is surrounded by a tightly mounted closing member.

The flange can be glued onto the plastics material layer at the bottom side of the cover by means of an adhesive joint or can also be welded onto the layer by means of a welding process of plastics material. The flange is preferably formed only when the welding process is carried out.

An especially tight connection between the pouring member and the cover is obtained when, above the flange, the pouring member has a downwardly open groove which is engaged by the material of the cover with an upwardly directed projection which is shaped in accordance with the flange. The upwardly directed projection can be formed by the pressure imparted during the welding process.

A preferred possibility for obtaining a tight connection between the pouring member and the tear-off member is characterized in that the closing member is formed by a closing plug and a tear-off member which is connected to the closing plug through a circumferential web and which tightly surrounds the bulge of the pouring ring.

Another preferred possibility is characterized in that the closing member is formed by a cap which surrounds the bulge of the pouring member and a cover foil which is arranged between the pouring member and the cap, is tightly connected to the pouring member and covers the pouring aperture of the pouring member.

In the following, the invention shall be explained with the aid of embodiments with reference to the enclosed drawings.

Figure 1:
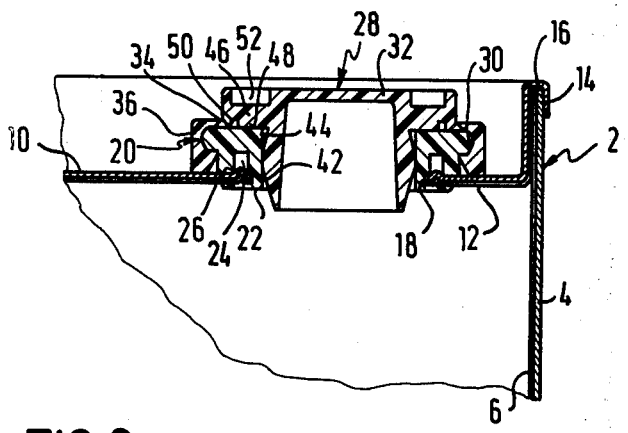
FIG. 1 shows a first closure in a vertical section.
Figure 2:
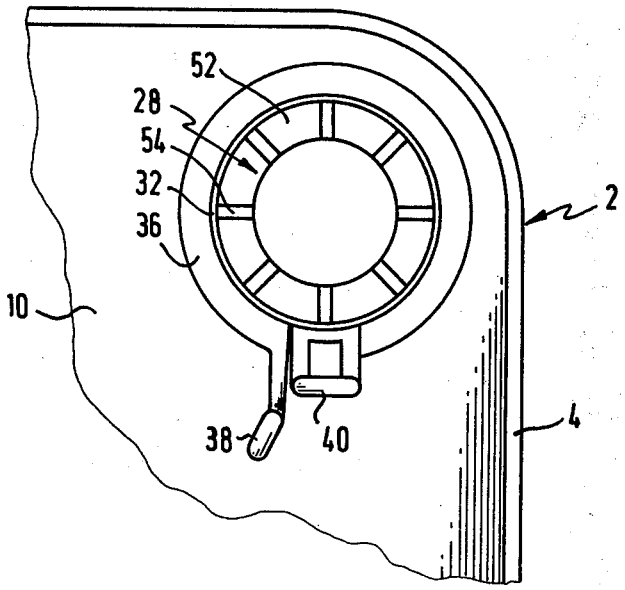
FIG. 2 shows the closure according to FIG. 1 in a top view.

FIGS. 1 and 2 show the upper corner region of a container 2. The body of the container 2 consists of a laminate 4 of aluminum (inside) and cardboard (outside) on whose inner and outer surfaces there is provided a layer 6 of a plastics material which is capable of heat-sealing. The cover 10 of the container 12 consists of aluminum whose inside is coated with a layer 12 of plastics material which is capable of heat-sealing. Plastics material layers of polyethylene have been found advantageous. The cover 10 is countersunk in the body 4 and its edge 14 is bent over the upper edge 16 of the body 4. The plastics material layers 6,12 are welded together by heating. A hole 18 is punched in the cover 10, a pouring member 20 being inserted in the hole 18. The pouring member 20 consists of plastics material and is provided with a flange 22 which is tightly connected to the plastics material layer 12 on the bottom side of the cover 10 by means of welding. Above the flange 22, the pouring member 20 is provided with a downwardly open groove 24 which is engaged by the material of the cover 10 with an upwardly directed projection 26 which is shaped in accordance with the flange. The hollow space above the projection 26 visible in FIG. 1 can be entirely filled with plastics material. This happens practically by itself when the pouring member 20 is welded to the cover 10 with the application of a low pressure on the flange 22 which possibly may be formed only when the welding is carried out.

At a distance from the upper side of the cover 10, the pouring member has a bulge 30 which is surrounded by a tightly mounted closing member 28.

In the embodiment according to FIGS. 1 and 2, the closing member 28 is formed by a closing plug 32 which, through a circumferential web 34, is connected to a tear-off member 36 which surrounds the bulge of the pouring member. The tear-off member 36 has a grip lug 38 and the closing plug 32 has a grip lug 40.

For opening the closure, the grip lug 38 is grasped and the tear-off member 26 is torn from the closing plug by ripping open the circumferential web 34. The closing plug 32 can then be pulled out of the pouring member 20 and can be reinserted as required. In doing so, a double-conical circumferential surface 42 of the closing plug 32 sealingly bears against the cylindrical inner surface 44 of the pouring member 20. An additional seal is obtained thereby that a circumferential flange 46 bears with its bottom side against the upper surface 48 of the pouring member 20. In cooperation with recesses 52 in the upper side of the circumferential flange 46, a groove 50 in the bottom side of the flange 22 facilitates the manual separation of the closing plug 32 from the pouring member 20. The recesses 52 are separated from one another by radial ribs 54.

Figure 3:
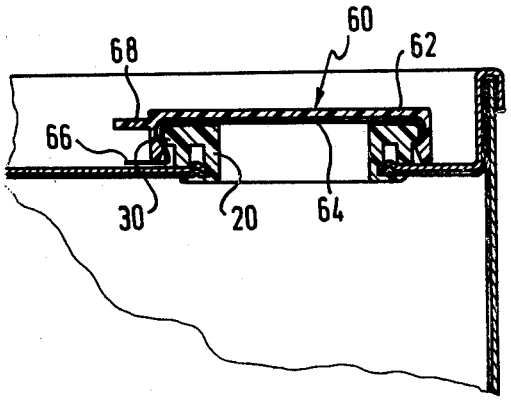
FIG. 3 shows a second closure in a vertical section.

In the embodiment according to FIG. 3, the container and the pouring member are constructed in the same manner as in the embodiment according to FIGS. 1 and 2. Therefore, they shall not be described once again.

The closing member 60 is formed by a cap 62 which surrounds the bulge 30 of the pouring member 20, a cover foil which is tightly connected to the pouring member 20 and covers the pouring aperture of the pouring member 20 being arranged between the cap 62 and the pouring member. The cover foil 64 has a lug 66 which can be grasped. The cap 62 is provided with a grip lug 68.

For opening the closure, the cap 62 is lifted off by grasping its grip lug 68; subsequently, the cover foil 64 is at least partially separated from the pouring member 20 by grasping at its lug 66. The cover foil 64 can then be discarded and the pouring member can be closed by means of the cap 62 alone.

We claim:

1. Device for the repeated opening and closing of an aperture in a container comprising a cover for the container having an outer surface and an inner surface with an aperture therethrough, said cover comprising a plurality of layers including a layer of metal and a layer of plastics material in contact with and covering said metal layer with said layer of plastics material forming the inner surface of said cover, a pouring member having a pouring opening therethrough inserted through the aperture in said cover and having a first portion extending inwardly of the inner surface of said cover and a second portion extending outwardly from the outer surface of said cover, the inner portion of said pouring member having a flange located inwardly of said layer of plastics material and extending outwardly from the aperture in said cover over and in contact with said layer of plastics material, said flange being tightly adhered to said layer of plastics material, said second portion of said pouring member having an outwardly projecting bulge spaced outwardly from and extending over the outer surface of said cover, and a closing member for said pouring member fitted over the outer portion of said pouring member and tightly surrounding said bulge.

2. Device according to claim 1, characterized in that said flange is glued onto said plastics material layer.

3. Device according to claim 1, characterized in that said flange is welded onto said plastics material layer.

4. Device according to one of claims 1, 2 or 3, characterized in that, above said flange, said pouring member 20 has a downwardly open groove, and said cover has an upwardly directed projection shaped in accordance with said flange and engaged within the downwardly open groove in said pouring member.

5. Device according to one of claims 1, 2 or 3, characterized in that said closing member comprising a closing plug removably inserted into the pouring opening in said pouring member a circumferential web 34 extending around said closing plug, and a tear-off member removably connected to and extending around said web with said tear-off member tightly surrounding said bulge of said pouring member.

6. Device according to claim 4, characterized in that said closing member comprises a cap 62 surrounding said bulge of said pouring member 20 and a cover foil arranged between said pouring member 20 and said cap 62, said cover face being tightly connected to said pouring member and covering the pouring opening of said pouring member 20.

7. Device according to claim 1, characterized in that said layer of a metal comprises a layer of aluminum.

8. Device according to claim 7, characterized in that said layer of a plastics material comprises a heat-sealable plastics material.

9. Device according to claim 8, wherein said heat-sealable plastics material layer is comprised of polyethylene.

* * * * *